US010814464B2

(12) United States Patent
Orchard

(10) Patent No.: US 10,814,464 B2
(45) Date of Patent: Oct. 27, 2020

(54) DECK CLIP MAGAZINE

(71) Applicant: Brian Keith Orchard, London (CA)

(72) Inventor: Brian Keith Orchard, London (CA)

( * ) Notice: Subject to any disclaimer, the term of this patent is extended or adjusted under 35 U.S.C. 154(b) by 350 days.

(21) Appl. No.: 15/293,783

(22) Filed: Oct. 14, 2016

(65) Prior Publication Data

US 2017/0106513 A1 Apr. 20, 2017

Related U.S. Application Data

(60) Provisional application No. 62/242,387, filed on Oct. 16, 2015.

(51) Int. Cl.

| | |
|---|---|
| ***B25C 1/00*** | (2006.01) |
| ***B65D 85/62*** | (2006.01) |
| ***E04F 21/20*** | (2006.01) |
| ***E04F 15/02*** | (2006.01) |
| ***B25C 5/16*** | (2006.01) |
| ***E04F 21/22*** | (2006.01) |
| ***B25C 7/00*** | (2006.01) |
| *B25C 1/18* | (2006.01) |

(52) U.S. Cl.

CPC ..... *B25C 1/001* (2013.01); *B25C 5/1693* (2013.01); *B25C 7/00* (2013.01); *B65D 85/62* (2013.01); *E04F 21/20* (2013.01); *E04F 21/22* (2013.01); *B25C 1/188* (2013.01); *E04F 15/02044* (2013.01)

(58) Field of Classification Search

CPC ..... B25C 1/001; B25C 1/008; B25C 5/16; B25C 5/1668; B25C 5/1693; B25C 1/184; B25C 1/188; E04F 15/02044; E04F 15/02094; E04F 2201/05; E04F 13/0826; E04F 21/20; F16B 12/00; F16B 12/20; B65D 85/62

USPC ..... 29/525.02, 525.03, 525.04; 173/31, 90; 227/120, 136, 18

See application file for complete search history.

(56) References Cited

U.S. PATENT DOCUMENTS 2,925,602 A * 2/1960 Kopf ..... B25C 1/188 227/8
3,060,440 A * 10/1962 De Caro ..... B25C 1/02 227/140
3,232,285 A * 2/1966 Rasner ..... A63B 65/122 124/21
3,570,738 A * 3/1971 Pabich ..... B25C 1/006 227/120
3,602,419 A * 8/1971 Doberne ..... B25C 1/00 227/147

(Continued)

*Primary Examiner* — Robert F Long
*Assistant Examiner* — Eduardo R Ferrero

(57) ABSTRACT

A deck clip magazine for use with a pneumatic fastener gun and a plurality of generally T-shaped deck clips attached to one another by webbing to form a clip belt. The deck clip magazine has a housing with a channel shaped to receive the clip belt and a front end with an opening to permit egress of the leading clip from the channel. An aperture on the housing is aligned with the barrel of the pneumatic fastener gun and permits fasteners to pass therethrough to secure the generally T-shaped clips in position. The clips are aligned below the aperture by way of an inwardly biased movable stop located adjacent the opening. A cutting mechanism is aligned with the webbing and selectively actuated to sever the webbing between adjacent clips in the clip belt.

12 Claims, 10 Drawing Sheets

(56) References Cited

U.S. PATENT DOCUMENTS 3,612,378 A * 10/1971 Pabich ..... B25C 1/006 227/120
3,638,892 A * 2/1972 Boye ..... B25B 31/00 227/9
3,693,220 A * 9/1972 Pabich ..... B25C 1/006 206/343
3,734,377 A * 5/1973 Munn ..... B25C 1/006 227/120
3,762,620 A * 10/1973 Geist ..... B25C 1/008 227/8
3,779,105 A * 12/1973 Triplett ..... B25B 13/488 411/38
3,809,307 A * 5/1974 Wandel ..... B25C 1/008 227/8
3,827,509 A * 8/1974 Larson ..... B25C 1/00 173/128
3,905,535 A * 9/1975 Novak ..... B25C 1/008 227/120
3,906,819 A * 9/1975 Curtis ..... B25B 23/14 173/181
3,964,659 A * 6/1976 Eiben ..... B25C 1/008 227/8
4,033,499 A * 7/1977 Butler ..... B25C 5/1693 227/120
4,040,554 A * 8/1977 Haytayan ..... B25C 1/008 227/8
4,060,089 A * 11/1977 Noiles ..... A61B 17/0643 227/60
4,082,475 A * 4/1978 Kuder ..... B23Q 5/048 173/29
4,091,981 A * 5/1978 Moriguchi ..... B25C 1/001 227/130
4,094,490 A * 6/1978 Einhorn ..... A47G 1/20 248/304
4,211,353 A * 7/1980 Aunis ..... B25C 1/008 173/13
4,214,490 A * 7/1980 Chizek ..... A22C 17/10 101/26
4,339,065 A * 7/1982 Haytayan ..... B25C 1/006 227/113
4,346,831 A * 8/1982 Haytayan ..... B25C 1/001 227/8
4,375,867 A * 3/1983 Novak ..... B25C 1/005 227/109
4,424,929 A * 1/1984 Weis ..... B25B 31/00 227/113
4,448,338 A * 5/1984 Graf ..... B25C 1/008 227/8
4,485,952 A * 12/1984 Weis ..... B25C 5/1693 227/10
4,538,483 A * 9/1985 Batten ..... B25B 21/001 81/56
4,541,402 A * 9/1985 Winters ..... A01K 11/00 124/27
4,597,517 A * 7/1986 Wagdy ..... B25C 1/008 227/120
4,630,766 A * 12/1986 Steeves ..... B25B 31/00 227/113
4,684,050 A * 8/1987 Masas ..... B25C 1/188 227/10
4,703,883 A * 11/1987 Losada ..... F16B 19/14 227/9
4,708,552 A * 11/1987 Bustos ..... F16B 13/126 248/231.91
4,729,164 A * 3/1988 Steeves ..... B25B 31/00 227/120
4,805,824 A * 2/1989 Erickson ..... B25B 31/00 206/340
4,809,568 A * 3/1989 DeCaro ..... B25B 23/10 227/149
4,821,937 A * 4/1989 Rafferty ..... B25C 1/008 227/142
4,974,685 A * 12/1990 Coffenberry ..... B25B 27/0042 173/138
5,016,802 A * 5/1991 Haytayan ..... B25C 1/082 173/DIG. 2
5,025,968 A * 6/1991 Nasiatka ..... B25C 1/008 227/31
5,035,354 A * 7/1991 Meyer ..... B25C 1/008 227/130
5,094,380 A * 3/1992 Nasiatka ..... B25C 7/00 227/130
5,193,730 A * 3/1993 Tanaka ..... B25C 1/008 227/113
5,199,506 A * 4/1993 Dewey ..... B25C 1/001 173/104
5,316,422 A * 5/1994 Coffman ..... B21J 15/022 411/107
5,378,102 A * 1/1995 Mossman ..... B25B 21/002 227/140
5,385,286 A * 1/1995 Johnson, Jr. ..... B25C 1/047 227/8
5,443,344 A * 8/1995 Underwood, Jr. ..... B21J 15/043 248/231.21
5,458,608 A * 10/1995 Wortrich ..... A61B 17/00234 227/110
5,484,094 A * 1/1996 Gupta ..... B25C 1/18 227/113
5,517,883 A * 5/1996 Goldi ..... B25B 23/12 411/368
5,564,614 A * 10/1996 Yang ..... B25C 1/008 227/142
5,579,977 A * 12/1996 Yang ..... B25C 1/008 227/142
5,673,839 A * 10/1997 Howard ..... B21J 15/28 173/21
5,772,381 A * 6/1998 Olvera ..... B25C 1/18 411/368
5,836,501 A * 11/1998 Lai ..... B25C 1/008 227/8
5,875,951 A * 3/1999 Ingle ..... B25C 1/02 173/90
5,943,926 A * 8/1999 Habermehl ..... F16B 27/00 206/347
5,947,362 A * 9/1999 Omli ..... B25C 5/1693 227/120
6,079,398 A * 6/2000 Grimm ..... A63H 27/14 124/16
6,089,437 A * 7/2000 Blacket ..... B21J 15/32 227/136
6,109,474 A * 8/2000 Haugen ..... B25C 5/1693 221/71
6,123,241 A * 9/2000 Walter ..... B25C 1/08 123/46 SC
6,145,723 A * 11/2000 Gupta ..... B25C 1/08 227/113
6,145,725 A * 11/2000 Omli ..... B25C 5/1693 227/120
6,199,739 B1 * 3/2001 Mukoyama ..... B25C 1/008 227/120
6,213,371 B1 * 4/2001 Cabrera ..... B25C 7/00 227/119
6,267,284 B1 * 7/2001 Clark ..... B25C 1/184 227/119
6,357,647 B1 * 3/2002 Ou ..... B25C 1/008 227/10
6,427,896 B1 * 8/2002 Ho ..... B25C 1/008 227/142
6,431,517 B1 * 8/2002 Chapman ..... E04B 1/4157 249/91
6,454,151 B1 * 9/2002 Wang-Kuan ..... B25C 1/003 227/142
6,478,209 B1 * 11/2002 Bruins ..... B25C 5/1693 227/136
6,523,621 B1 * 2/2003 Gosis ..... B25C 1/008 173/168
6,598,775 B1 * 7/2003 Chen ..... B25C 7/00 227/113

(56) References Cited

U.S. PATENT DOCUMENTS 6,742,509 B2 * 6/2004 Hunter ..... F41B 3/02 124/17
6,755,597 B2 * 6/2004 Bergner ..... B23Q 7/10 144/136.95
6,783,048 B2 * 8/2004 Powell ..... F16B 13/085 227/113
6,908,022 B2 * 6/2005 Schmitz ..... B25C 5/1693 227/119
6,978,698 B2 * 12/2005 Hofbrucker ..... B25B 23/06 227/114
7,044,031 B1 * 5/2006 Mullen ..... B25B 13/06 81/120
7,052,200 B2 * 5/2006 Harris ..... E04F 15/04 403/231
7,093,338 B2 * 8/2006 Powers ..... F16B 19/14 227/107
7,096,972 B2 * 8/2006 Orozco, Jr. ..... B25D 11/102 173/114
7,140,524 B2 * 11/2006 Hung ..... B25C 1/008 227/8
7,232,050 B2 * 6/2007 Omli ..... A41H 37/04 227/15
7,344,058 B2 * 3/2008 Bruins ..... B25C 5/1693 227/119
7,387,173 B2 * 6/2008 Jinnings ..... E02D 7/10 173/147
7,448,371 B2 * 11/2008 Sapir ..... F41B 3/005 124/16
7,513,404 B2 * 4/2009 Shkolnikov ..... B25C 1/008 227/130
7,530,483 B2 * 5/2009 Bruins ..... B25C 7/00 227/120
7,758,612 B2 * 7/2010 Shipp ..... A61B 17/064 600/142
7,918,879 B2 * 4/2011 Yeung ..... A61B 17/0401 606/139
8,011,153 B2 * 9/2011 Orchard ..... E04F 15/02 24/295
8,047,100 B2 * 11/2011 King ..... B25B 23/00 81/451
8,056,785 B2 * 11/2011 Gosis ..... B25C 7/00 227/140
8,061,000 B2 * 11/2011 Santamarina ..... B25B 31/00 173/128
RE42,987 E * 12/2011 Akiba ..... B25C 1/008 227/130
8,256,614 B1 * 9/2012 Wadsworth, Sr. ..... F16B 15/08 206/340
9,061,407 B2 * 6/2015 Chien ..... B25C 1/06
2001/0000404 A1 * 4/2001 Losada ..... B25C 1/005 227/119
2001/0030138 A1 * 10/2001 Bruins ..... B25C 1/006 206/343
2001/0048016 A1 * 12/2001 Akiba ..... B25C 1/008 227/8
2001/0054635 A1 * 12/2001 Schmitz ..... B25C 5/1693 227/15
2003/0035702 A1 * 2/2003 Lin ..... F16B 27/00 411/442
2003/0102350 A1 * 6/2003 Liu ..... B25C 5/1693 227/18
2003/0192930 A1 * 10/2003 Lamb ..... B25C 1/006 227/18
2004/0112933 A1 * 6/2004 Lamb ..... B25C 5/1693 227/18
2004/0194422 A1 * 10/2004 Rodenhouse ..... E04F 13/045 52/741.1
2005/0023319 A1 * 2/2005 Huang ..... B25C 1/008 227/8
2005/0156006 A1 * 7/2005 Chen ..... B25C 1/005 227/8
2007/0107199 A1 * 5/2007 Haytayan ..... B25C 1/188 29/525.01
2008/0048001 A1 * 2/2008 Shor ..... B25C 5/1693 227/147
2008/0135596 A1 * 6/2008 Wu ..... B25C 1/008 227/8
2008/0197165 A1 * 8/2008 Chen ..... B25C 1/008 227/8
2009/0084567 A1 * 4/2009 Basham ..... B25C 7/00 173/29
2010/0019014 A1 * 1/2010 Rodenhouse ..... B25B 21/002 227/32
2010/0327037 A1 * 12/2010 Zhang ..... B25C 1/008 227/8
2011/0314765 A1 * 12/2011 Martel ..... E04F 15/02044 52/745.05
2012/0104070 A1 * 5/2012 Wu ..... B25C 1/008 227/8
2012/0325886 A1 * 12/2012 Adachi ..... B25C 1/06 227/2
2013/0104493 A1 * 5/2013 Orchard ..... E04F 15/02044 52/704
2013/0247504 A1 * 9/2013 Pelc ..... E04F 15/02 52/704
2014/0021236 A1 * 1/2014 Martel ..... E04F 15/02044 227/18
2014/0138422 A1 * 5/2014 Ronconi ..... B25C 1/001 227/18
2014/0186109 A1 * 7/2014 Wadsworth ..... E04F 15/02 403/404
2014/0305068 A1 * 10/2014 Svanberg ..... B25B 23/045 52/711
2015/0040514 A1 * 2/2015 Hinkle ..... E04F 21/22 52/745.13
2015/0136829 A1 * 5/2015 Howes ..... B25C 1/008 227/140
2017/0036333 A1 * 2/2017 Lin ..... B25C 1/005
2018/0223547 A1 * 8/2018 Demuth ..... B25C 5/1693

* cited by examiner

DECK CLIP MAGAZINE

BACKGROUND OF THE INVENTION

The invention relates to a deck clip magazine intended to facilitate the installation of outdoor decking by "invisible" or hidden attachment means. According to this method of attachment, decking members are secured to the underlying joist structure without the insertion of securement nails or screws into the visible top surface of the decking member. The decking members are installed and held in place by means of clips attached to an underlying joist structure as described, for example in U.S. Pat. No. 8,011,153 B2, entitled "Deck Fastener and Method of Use", also in the name of the present inventor.

The use of this type of attachment requires that the clip be fixedly secured to the underlying joist structure and decking member. In the example clip used to describe an embodiment of the invention, the decking members are adapted with a longitudinal groove in each side edge along the entire length of the decking member. The clips have opposed flanges which are retained within the grooves of adjacent decking members thereby securing the decking members to the joist by means of the clip. According to this system and method of installation, there is no penetration of any surface of the decking member by any fastening means which is particularly advantageous with the emerging use and availability of non-wood, PVC or composite decking materials which are more expensive than treated lumber or cedar.

Ordinarily, the clip is secured to the underlying joist structure by means of a screw fastener typically installed by a hand held power driver. The use of a pneumatic screw gun makes the installation more efficient with the use of a magazine for storing a plurality of screw fasteners thus eliminating the need for individual handling of each screw fastener.

SUMMARY OF THE INVENTION

A deck clip magazine, according to the present invention, is used with a pneumatic fastener gun and a plurality of generally T-shaped deck clips attached to one another by webbing to form a clip belt having a leading clip. The deck clip magazine has a housing with a channel shaped to receive the clip belt, a front end with an opening to permit egress of the leading clip from the channel, and an aperture aligned with the barrel of the pneumatic fastener gun and shaped to permit passage of the fasteners from the pneumatic fastener gun therethrough. An inwardly biased movable stop is located adjacent the opening and configured to retain the clip belt within the channel, so as to position the leading clip with its fastening aperture in vertical alignment with the aperture and the barrel of the pneumatic fastener gun and with one side of the top horizontal portion of the leading clip protruding beyond the opening. The inwardly biased movable stop is releasable to permit egress of the leading clip. A cutting mechanism aligned with the webbing between the leading clip and the adjacent clip is selectively actuable to sever the webbing between the leading clip and the adjacent clip in the clip belt. A spring-loaded follower is located in the channel and biased toward the front end to advance the deck clips towards the opening against the inwardly biased movable stop.

In another embodiment, the deck clip magazine has a plunger switch extending forwardly from the front end of the housing, which is operatively engaged with the safety mechanism on the pneumatic faster gun and biased outwardly so as to deactivate the safety only when the plunger switch is depressed.

BRIEF DESCRIPTION OF THE DRAWINGS

In order that the invention may be more clearly understood, a preferred embodiment thereof will now be described in detail by way of example, with reference to the accompanying drawings, in which.

DESCRIPTION OF THE INVENTION

Figure 1:
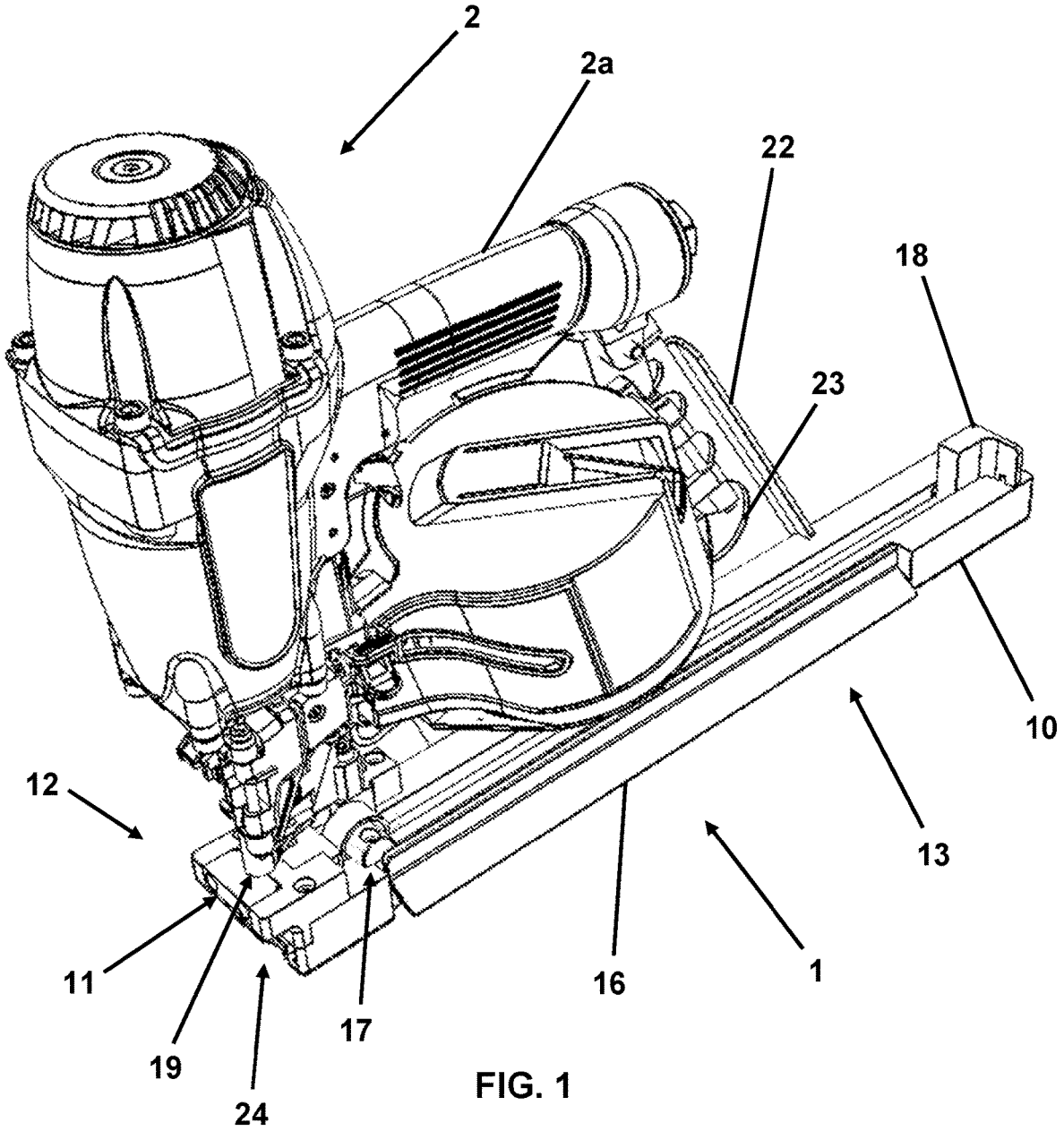
FIG. 1 is an isometric view of the deck clip magazine according to the present invention (or "magazine"), installed on a pneumatic screw gun.
Figure 2:
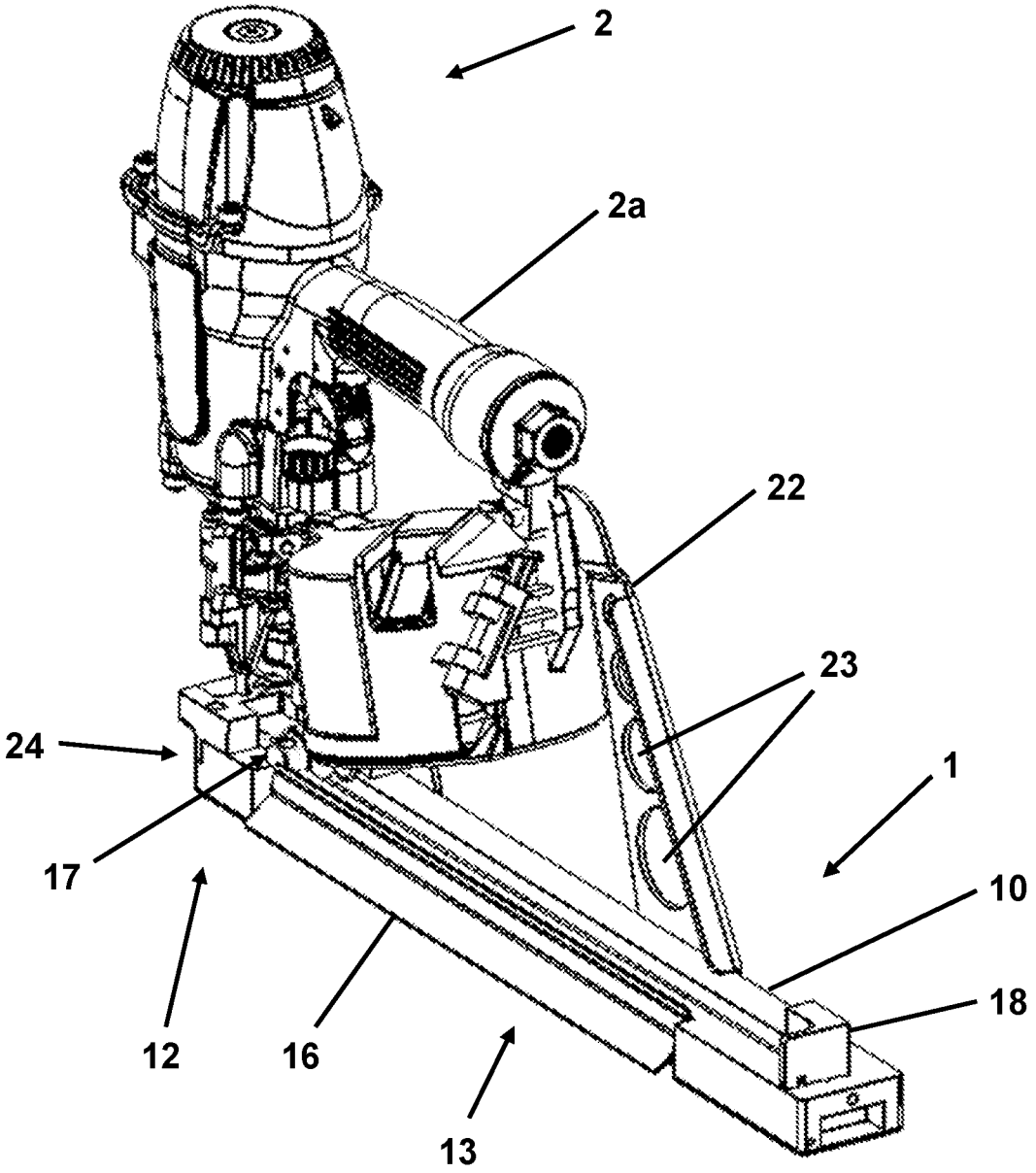
FIG. 2 is another isometric view of the magazine, installed on a pneumatic screw gun.

The deck clip magazine according to the present invention is intended to be used with a pneumatic fastening tool, such as a screw gun 2. The deck clip magazine 1 is configured to receive specialized T-shaped dips 3, shown in FIGS. 9-12, having a top horizontal portion 4 and a vertical portion 5, integral with the top horizontal portion 4 and oriented generally perpendicular to the underside of the top horizontal portion 4. Preferably, the top horizontal portion 4 is flat and generally square-shaped, while the vertical portion 5 is generally rectangular and extends beyond the ends 6 of the top horizontal portion 4 to provide positioning tabs 7 on either end 6 of the T-shaped clip 3. The two regions of the top horizontal portion 4 extending from either side of the vertical portion 5 define the horizontal flanges 8 of the T-shaped clip 3, which engage with the decking member to retain it in place, as further described below.

The T-shaped clips 3 have a fastening aperture 9 passing through the T-shaped clip 3, oriented perpendicular to the top horizontal portion 4 and parallel to the vertical portion 5. The fastening aperture 9 receives a fastener, such as a nail or screw, to thereby attach the T-shaped clip 3 to a joist or other decking support structure, as further described below. Preferably, the T-shaped clips 3 are an integrally formed unit made of a thermoplastic material, but may also be made of composite material or metal.

The T-shaped clips 3 are intended to be used in conjunction with a deck member or plank which is manufactured with a longitudinal groove or slot in each opposing end. In use, the horizontal flanges 8 are inserted within the groove of a deck member and the T-shaped clip 3 is securely fastened to the surface of a supporting deck structure, such as a joist structure, and serves as an anchoring device to secure the deck members to the joist structure. This method of installing deck members is especially useful for more expensive deck members manufactured from non-wood, PVC, or composite materials. Traditional wood deck members may also be used.

Figure 13:
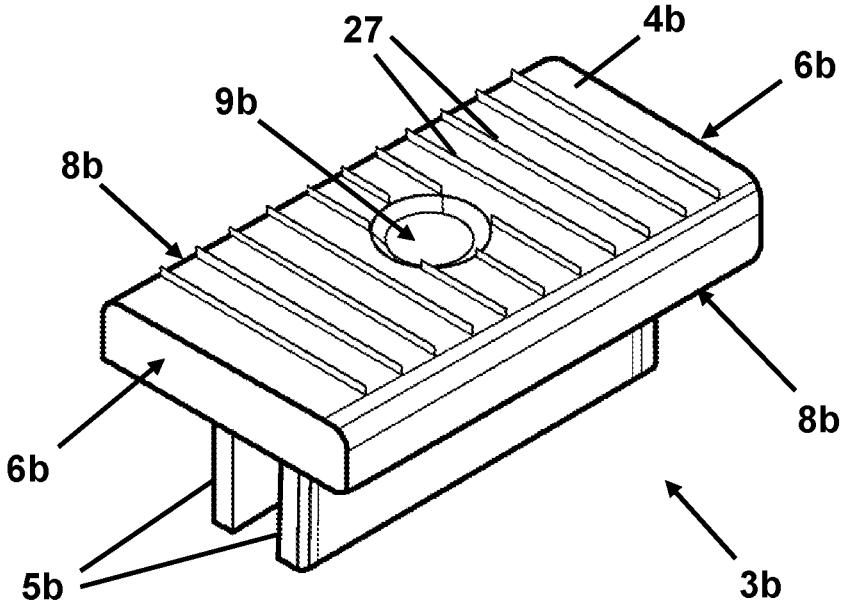
FIG. 13 is an isometric view of a 7-shaped clip, which may be used as an alternative to the T-shaped clips, shown in FIGS. 8-12.

Alternatively, a π-shaped clip 3 *b*, as shown in FIG. 13, may be used in place of the T-shaped clips 3. The π-shaped clips 3 *b* have a top horizontal portion 4 *b* and a pair of integrally formed spaced apart vertical legs 5 *b*. The two regions of the top horizontal portion 4 *b* extending from either side of the vertical legs 5 *b* define the horizontal flanges 8 *b* of the π-shaped clip 3*b*. The top horizontal portion 4 *b* has a fastening aperture 9 *b*, which permits a fastener to pass therethrough and between the vertical legs 5 *b*. The top of the top horizontal portion 4 *b* may also have raised grips 27 for frictional engagement within the longitudinal groove of the deck member. The ends 6 *b* of the top horizontal portion 4 *b* extend slightly past the ends of the vertical legs 5 *b*. The ends of the vertical legs 5 *b* perform a positioning function as described further herein.

Referring to FIGS. 1-7, the deck clip magazine 1 has a housing 10 with a front end 11, which is attached to the head of the screw gun 2. The housing 10 has an operative section 12 at the front end 11 and a storage section 13, which extends rearwardly therefrom. The operative section 12 of the housing 10 contains the advancement, alignment, and cutting mechanisms that operate to position the fastening aperture 9 of a T-shaped clip 3 below the barrel of the screw gun 2 to receive a fastener and then separate the leading T-shaped clip 3*a* from the next T-shaped clip 3 in the belt 14. The housing 10 has an opening 11*a* on its front end 11 and a channel 10*a*, or a hollow interior, which is shaped to receive a string, or belt 14, of connected T-shaped clips 3 and retain them therein. As shown in FIGS. 9-12, the belt 14 consists of a plurality of T-shaped clips 3 connected to one another by webbing 15.

Figure 4:
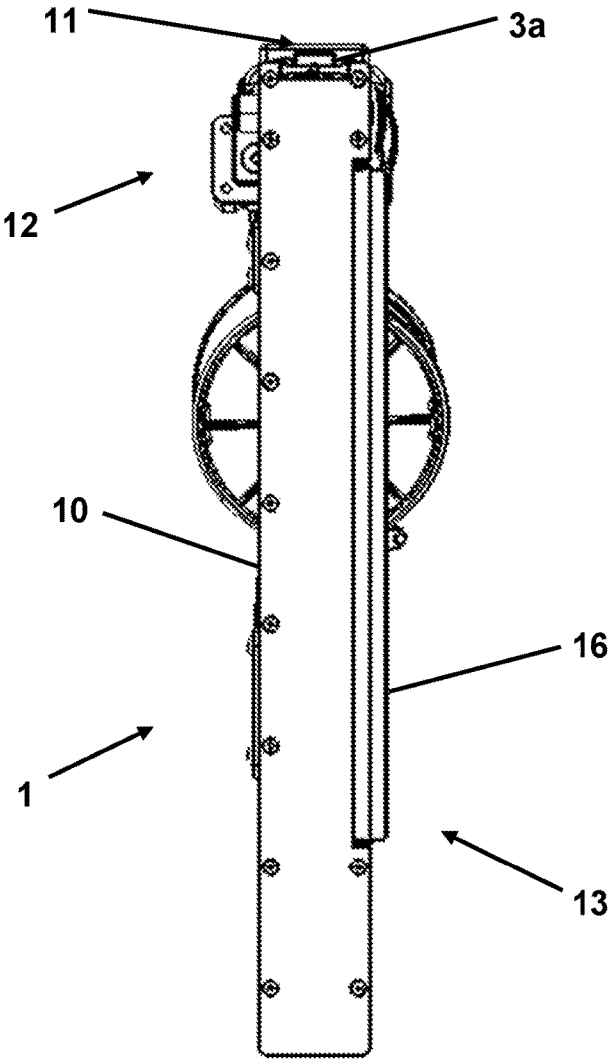
FIG. 4 is a bottom view of the magazine, installed on a pneumatic screw gun.
Figure 3:
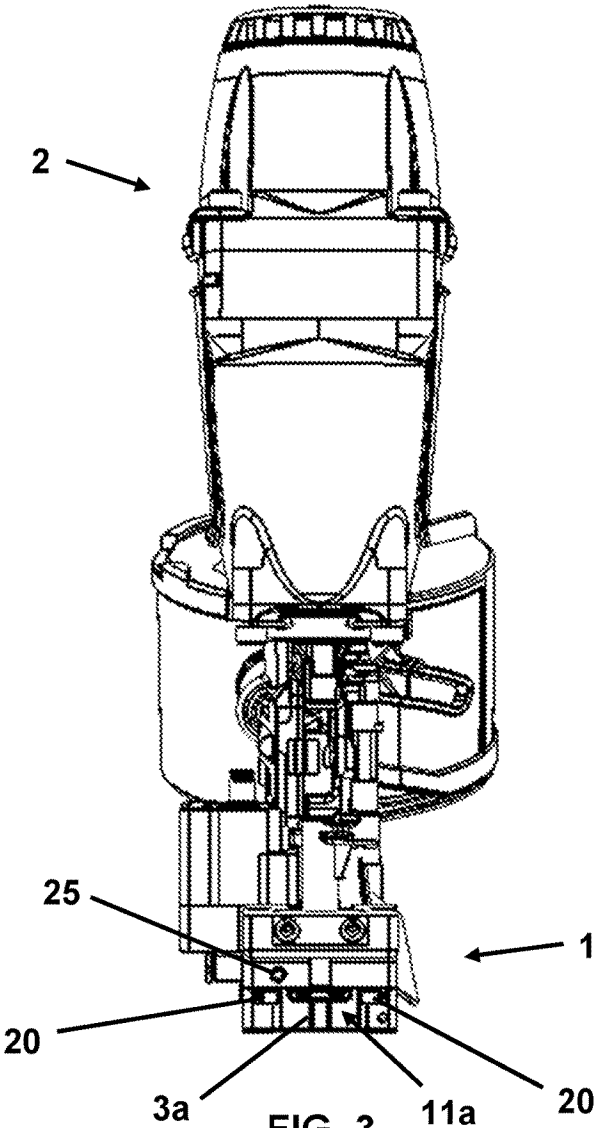
FIG. 3 is a front view of the magazine, installed on a pneumatic screw gun.
Figure 5:
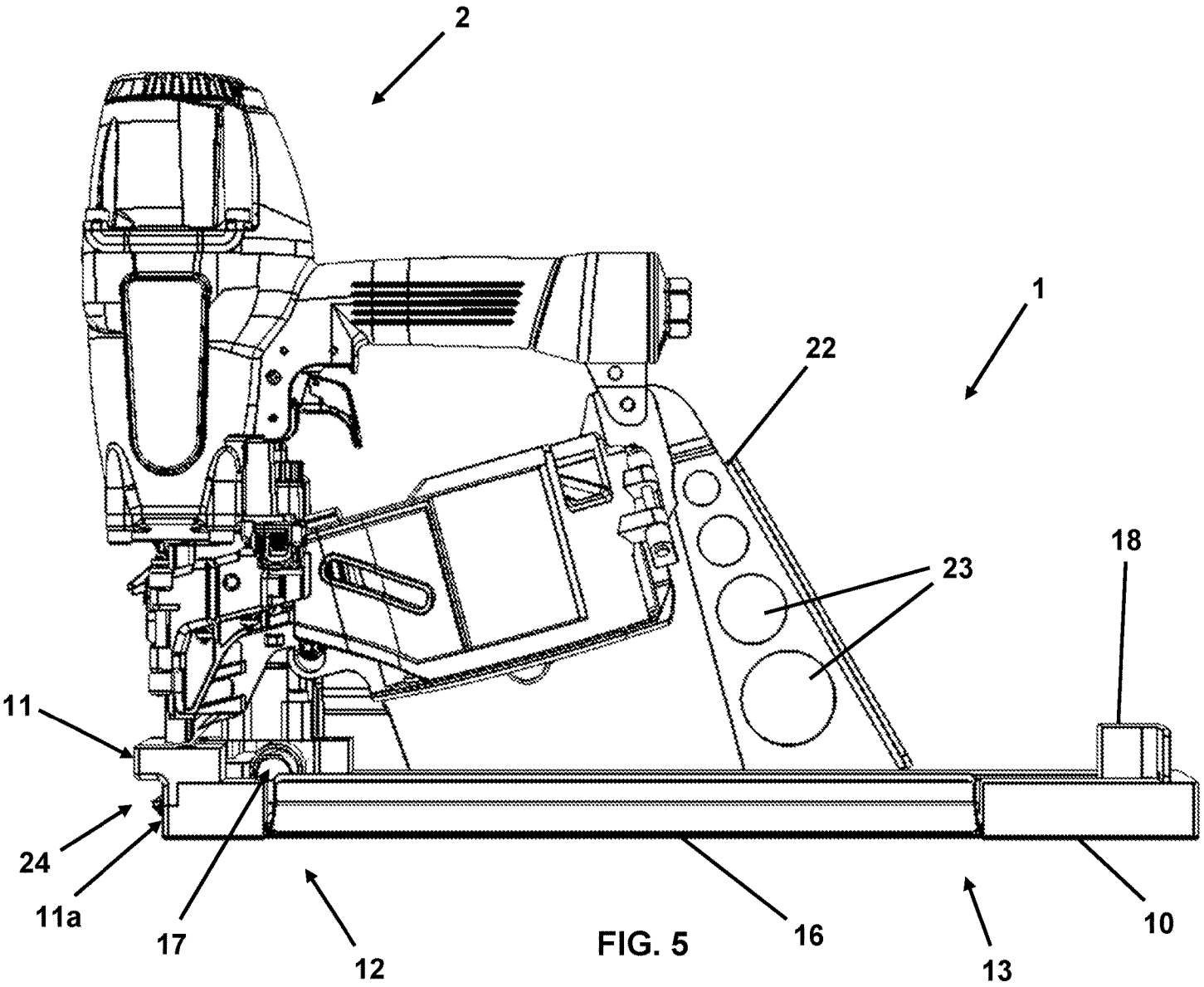
FIG. 5 is a side view of the magazine, installed on a pneumatic screw gun.

As shown in FIGS. 4 and 5, the housing 10 encloses the channel 10*a* on all sides, except for the opening 11*a* at the front end 11, and has a hinged door 16 on one side of the storage section 13 through which a belt 14 may be loaded. Alternatively, the housing 10 may have an open bottom with two rails extending along at least a portion of the open bottom (not shown) to retain the belt 14 within the channel 10*a*.

Preferably, the advancement mechanism consists of a constant force spring 17 and a follower 18, which advances the T-shaped clips 3 within the channel 10*a* towards the front end 11. The constant force spring 17 has a steel strip 17*a*, coiled at one end around a drum 17*b* mounted at the operative section 12 and attached at the opposite end to the follower 18. Alternatively, a coiled spring or other type of spring may be used to bias the follower 18 towards the front end 11 and thereby advance the T-shaped clips 3 within the channel 10*a*.

At the front end 11, the operative section 12 of the deck clip magazine 1 is attached to the head of a pneumatic screw gun 2. The attachment mechanism relies on pre-existing fastening locations on the head of the tool or otherwise adapting the tool to permit attachment to the deck clip magazine 1. The deck clip magazine 1 may also be included as part of the design of a pneumatic screw gun 2, or similar tool. The operative section 12 of the housing 10 has an aperture 19 through the thickness of the deck clip magazine 1 aligned beneath the barrel of the screw gun 2. The aperture 19 permits passage of the screws to embed in the joist structure and may be shaped to receive a portion of the barrel of the screw gun 2.

The operative section 12 of the housing 10 also houses the alignment and cutting mechanisms. As shown in FIGS. 8-12, the alignment mechanism engages the leading T-shaped clip 3 *a* in the belt 14 and limits the forward motion of the belt 14 within the channel 10 *a* to position the leading T-shaped clip 3 *a* with its fastening aperture 9 aligned beneath the barrel of the screw gun 2, to receive a fastener therein. Preferably, two hooks 20 are positioned facing inward on either side of the opening 11 *a* on the front end 11 of the housing 10 to thereby catch the positioning tabs 7 extending on either end of the leading T-shaped clip 3 *a*. If a π-shaped clip 3 *b* is used, the hooks 20 are positioned slightly lower, so as to catch the ends of the vertical legs 5 *b*, below the top horizontal portion 4 *b*. The hooks 20 may be deflected outwardly by an external force, such as the force applied by a user moving the tool away from the decking member after driving a nail or screw into the joist structure through the fastening aperture 9 of the leading T-shaped clip 3 *a*. However, the force provided by the constant force spring 17 is not sufficient to deflect the hooks 20 outwardly. The hooks 20 are thereby biased inwardly with a force sufficient to limit the forward motion of the belt 14, under the force applied by the constant force spring 17, but which may be overcome. Alternatively, two inwardly-biased rollers may be used in place of the hooks 20 to limit the forward motion of the belt 14.

The cutting mechanism is also housed within the operative section 12 of the housing 10 and severs the webbing 15 between the leading T-shaped clip 3*a* and the adjacent T-shaped clip 3 in the belt 14, thereby permitting the leading T-shaped clip 3*a* to remain in place on the deck once fastened to the joist structure. The advancement mechanism then indexes the next T-shaped clip 3 into position, as the new leading T-shaped clip 3*a*. Preferably, a guillotine-style cutting blade 21 is positioned above the webbing 15, behind the trailing end of the leading T-shaped clip 3*a*. When the screw gun 2 is actuated to drive a fastener through the fastening aperture 9 of the leading T-shaped clip 3*a* and into the joist structure, the cutting blade 21 is actuated to move between the leading T-shaped clip 3*a* and the adjacent T-shaped clip 3 in the belt 14, thereby severing the webbing 15 and releasing the leading T-shaped clip 3*a*. The actuation of the cutting blade 21 may be powered by the same source of compressed air that powers the screw gun 2.

At or near the rear end, the storage section 13 of the housing 10 is secured to the handle 2*a* of the screw gun 2 by a support bar 22. The length of the support bar 22 may be selected to provide the desired angle of the deck clip magazine 1, relative to the screw gun 2. Alternatively, the length of the support bar 22 may be adjustable. The support bar 22 may have cut outs 23 therethrough to reduce the weight of the deck clip magazine 1 without compromising the structural integrity of the support bar 22.

The housing 10 has a recess 24 on its front end 11, which is shaped complementary to side edge of a decking member to permit the front end 11 of the housing 10 to abut against the decking member with a flush fit, when the deck clip magazine 1 is positioned against the adjacent joist structure. Placing the front end 11 of the housing 10 abutting against and overlapping the side edge of a decking member also aligns and positions the leading horizontal flange 8 of the leading T-shaped clip 3*a* within the groove of the decking member. In this position, with the front end 11 of the housing 10 in a flush fit against the adjacent decking member, the leading T-shaped clip 3*a* is in position to receive a fastener from the screw gun 2 and thereby secure the decking member to the underlying joist structure.

The front end 11 of the housing 10 also has a plunger switch 25 biased outwardly into the recess 24 that is operatively engaged with the safety mechanism of the screw gun 2. The plunger switch 25 is depressed by the decking member when the front end 11 is positioned abutting against the side edge of the decking member, thereby deactivating the safety on the screw gun 2 only when it is in position to fasten the leading T-shaped clip 3*a* to the joist structure.

Figure 14A:
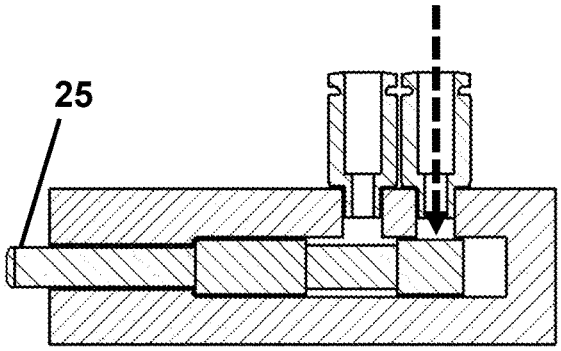
FIG. 14A is a schematic sectional view of an embodiment of the plunger switch mechanism for actuating the safety mechanism of the pneumatic screw gun, in the "safety on" position.
Figure 14B:
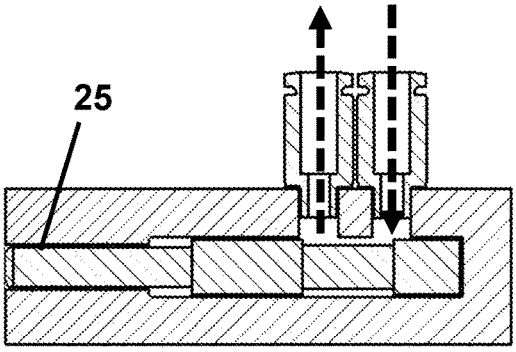
FIG. 14B is a schematic sectional view of the plunger switch mechanism shown in FIG. 14A, with the safety mechanism of the pneumatic screw gun deactivated.
Figure 15:
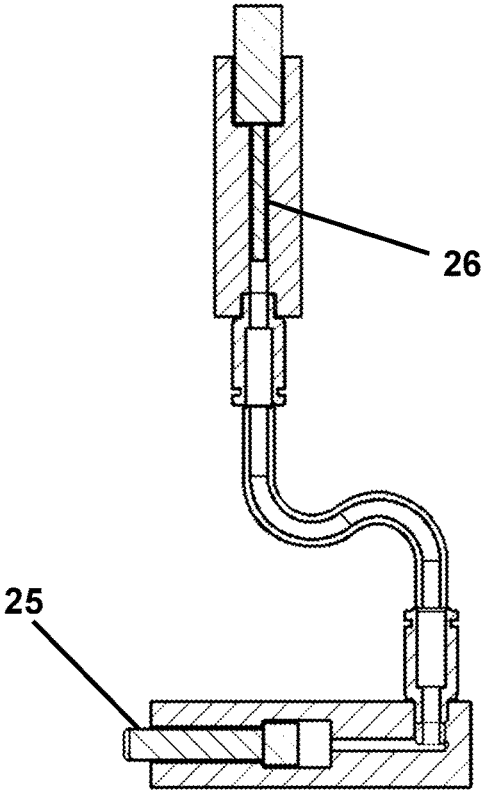
FIG. 15 is a schematic sectional view of another embodiment of the plunger switch mechanism for actuating the safety mechanism of the pneumatic screw gun.

Preferably, as shown in FIG. 14A, the plunger switch 25 is configured to block the flow of compressed air when not depressed by an adjacent decking member, causing the safety mechanism of the screw gun 2 to remain engaged in the "safety on" position. As shown in FIG. 14B, when the plunger switch 25 is depressed by an adjacent decking member, the compressed air is permitted to flow through the switch mechanism and actuate the safety mechanism of the screw gun 2, thereby deactivating the safety and permitting an operator to fire a screw. Alternatively, as shown in FIG. 15, the plunger switch 25 may act as a piston to displace the fluid in a hydraulic system attached to a safety pin 26 within the screw gun 2 and thereby actuate the safety mechanism when depressed by an adjacent decking member. The safety pin 26 is biased against actuation, in the "safety on" position, to prevent firing a screw when the plunger switch 25 is not being depressed by an adjacent decking member.

Figure 6A:
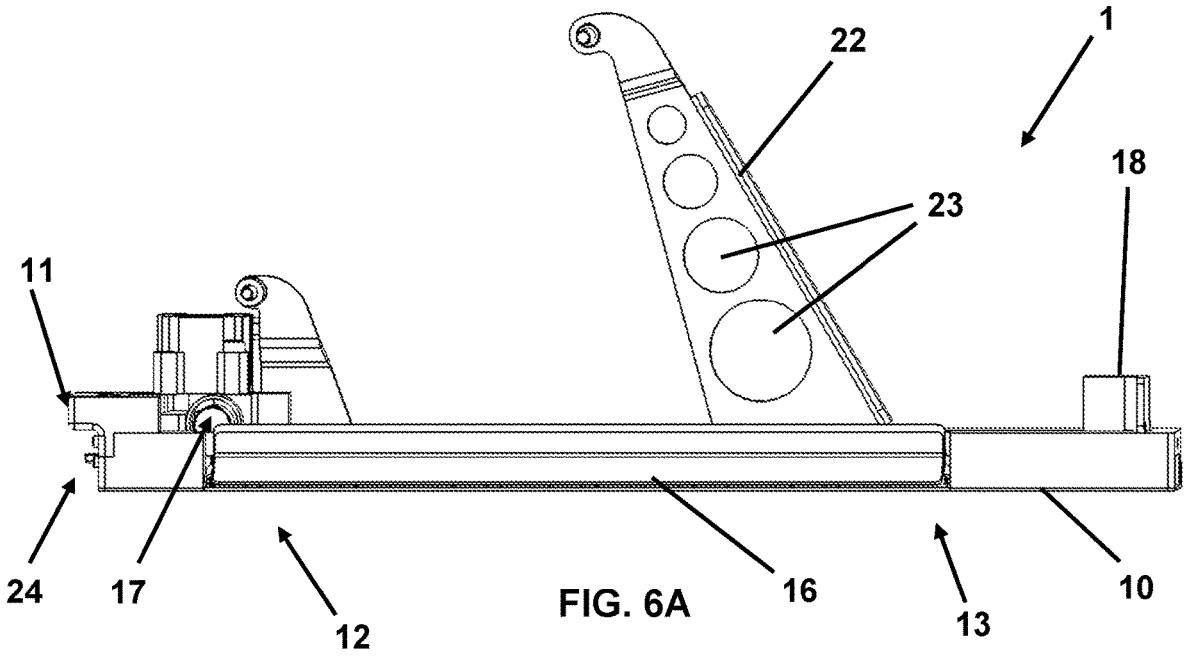
FIG. 6A is a side view of the magazine.
Figure 6B:
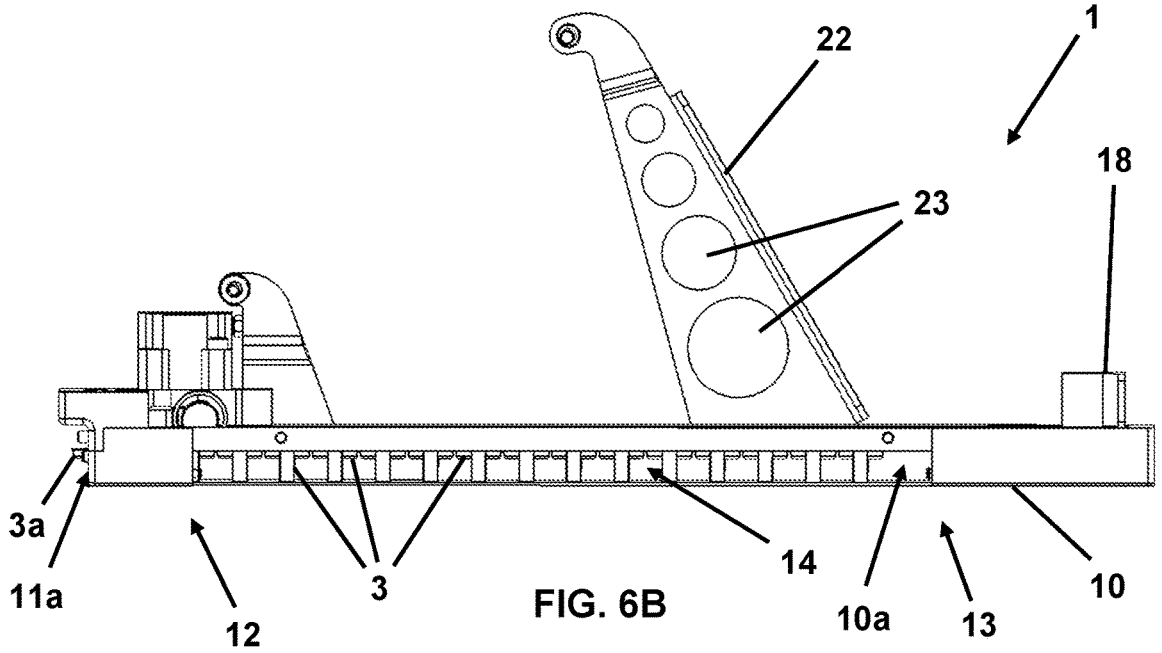
FIG. 6B is a side view of the magazine, with the hinged door removed to show the belt of T-shaped clips inside the magazine.
Figure 7:
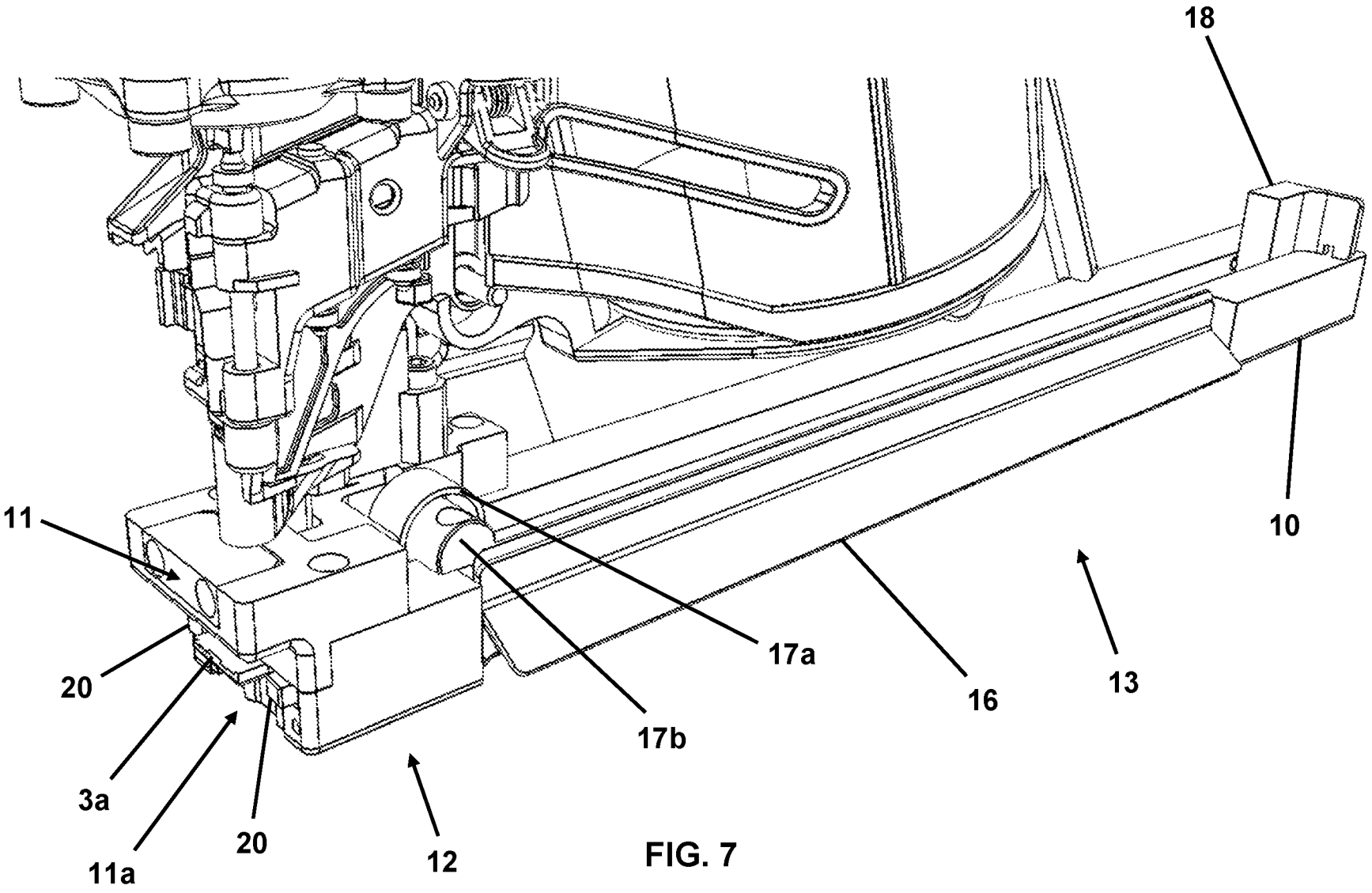
FIG. 7 is a close up isometric view of the magazine, installed on a pneumatic screw gun.
Figure 8:
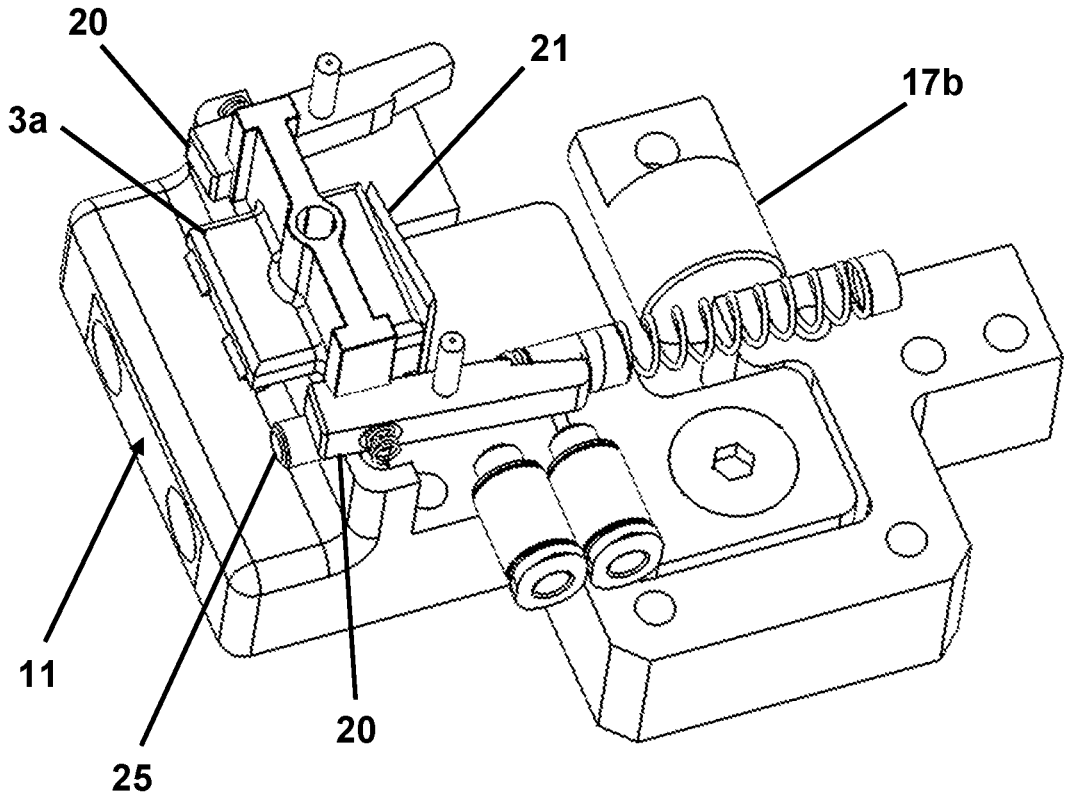
FIG. 8 is a detail view of the interior of the operative section of the magazine, with the bottom and sides removed to show the leading T-shaped clip and to show the alignment and cutting mechanisms.
Figure 9:
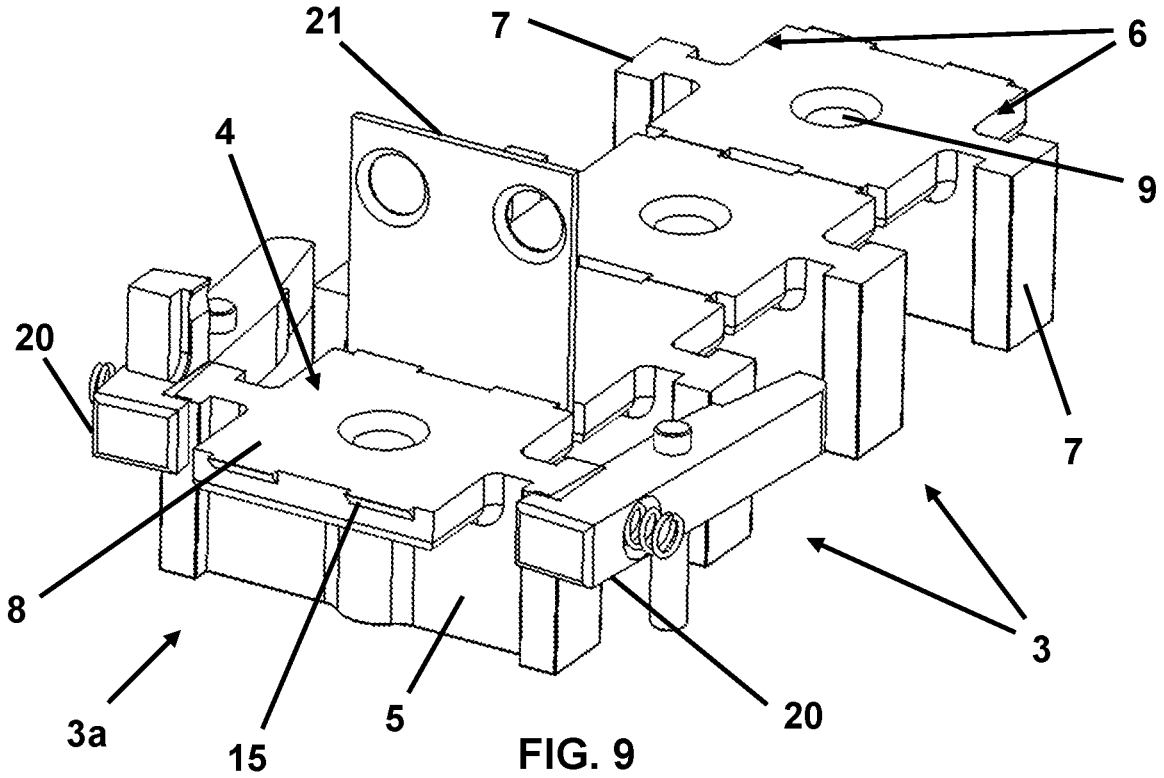
FIG. 9 is an isometric view of the alignment and cutting mechanisms of the magazine, shown with a belt of T-shaped clips.
Figure 10:
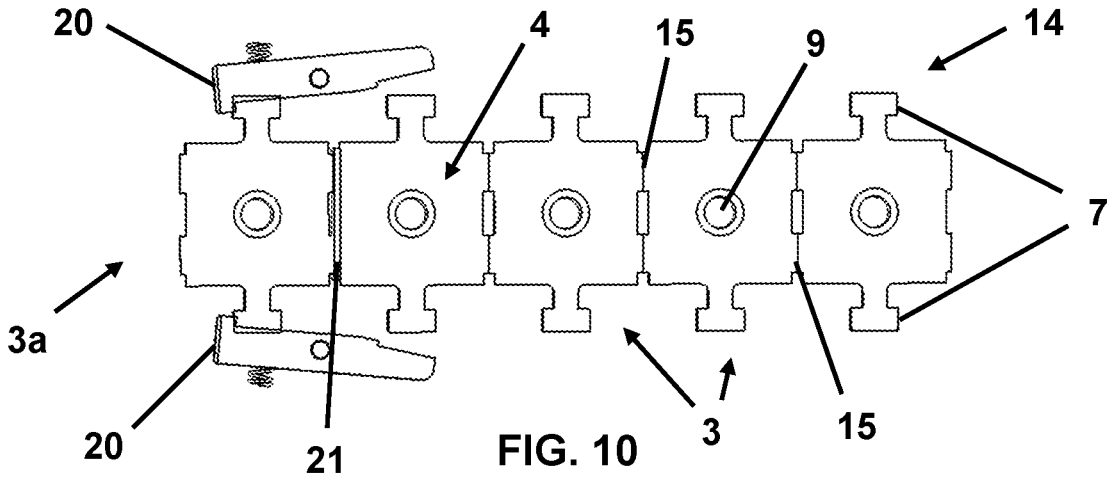
FIG. 10 is a top view of the alignment and cutting mechanisms of the magazine, shown with a belt of T-shaped clips.
Figure 11:
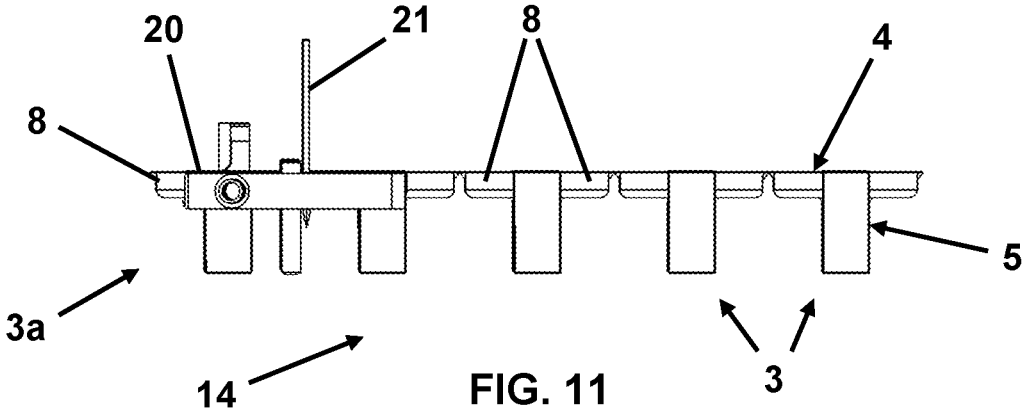
FIG. 11 is side view of the alignment and cutting mechanisms of the magazine, shown with a belt of T-shaped clips.
Figure 12:
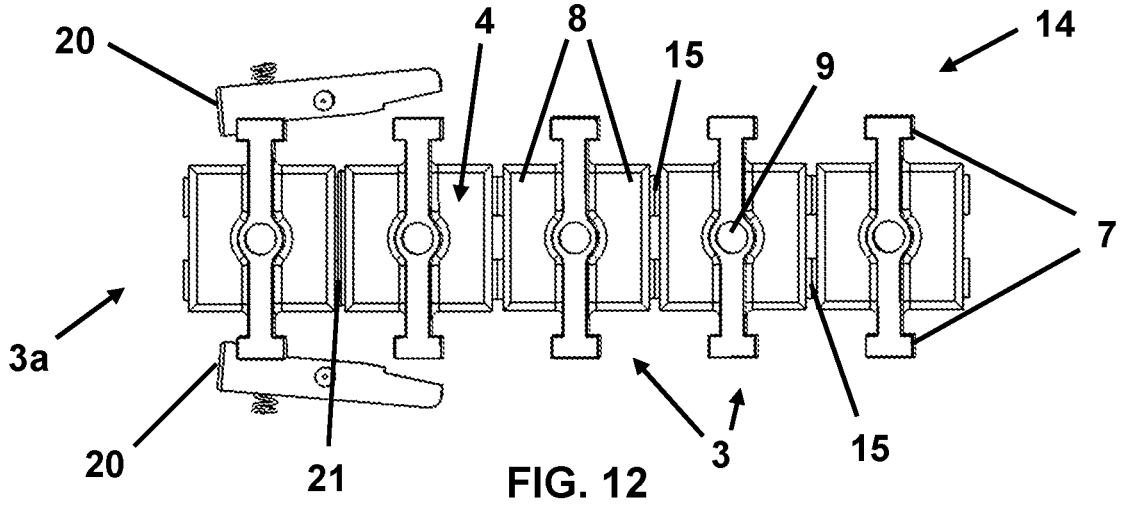
FIG. 12 is a bottom view of the alignment and cutting mechanisms of the magazine, shown with a belt of T-shaped clips.

In operation, a belt 14 of T-shaped clips 3 is manually placed within the storage section 13 of the deck clip magazine 1, as shown in FIG. 6B. The deck clip magazine 1 is placed over an underlying joist structure and urged forwardly to abut against the grooved edge of a deck member, thereby depressing the plunger switch 25 and deactivating the safety mechanism of the screw gun 2. The leading T-shaped clip 3*a* is operationally aligned under the aperture 19, beneath the head of the screw gun 2, and protrudes from the front end 11 of the deck clip magazine 1, as shown in FIG. 7, so that the leading horizontal flange 8 of the leading T-shaped clip 3*a* is insertable into the groove of the deck member. The leading T-shaped clip 3*a* is now in the installation position and ready to receive a screw fastener from the screw gun 2.

When the leading T-shaped clip 3*a* has been placed in the installation position, as described above, the screw gun 2 is operated. The cutting blade 21 is actuated and severs the webbing 15 between the leading T-shaped clip 3*a* and the next T-shaped clip 3 in the belt 14. A screw fastener is inserted through the fastening aperture 9 in the leading T-shaped clip 3*a* thereby securing the leading T-shaped clip 3*a* and the deck member to the joist structure. The screw gun 2 and deck clip magazine 1 are then moved away from the deck member, leaving the leading T-shaped clip 3*a* in place and allowing the advancement mechanism to index the next T-shaped clip 3 into position under the barrel of the screw gun 2 as the new leading T-shaped clip 3*a*. This process is repeated, as required, along the length of the deck member at each joist or other interval, as desired. The next adjacent deck member is manually placed on the joist structure and urged into position around the exposed horizontal flanges 8 of the installed T-shaped clips 3. The installation process then continues with reference to the next deck member.

Further advantages which are inherent to the invention are obvious to one skilled in the art. The embodiments are described herein illustratively and are not meant to limit the scope of the invention as set out in the following claims.

What is claimed is:

1. A deck clip magazine, for use with a pneumatic fastener gun for installing decking members using a plurality of generally T-shaped deck clips each having a top horizontal portion with opposing sides and at least one integrally formed vertical portion extending downwardly from the top horizontal portion spaced apart from the opposing sides and a fastening aperture located centrally on the top horizontal portion for receiving a fastener, and wherein the plurality of generally T-shaped deck clips are attached to one another by webbing to form a clip belt having a leading clip, the deck clip magazine comprising:

a housing having a channel defining a forward and rearward direction and shaped to receive the clip belt, a front end with an opening to permit egress of the leading clip forwardly from the channel, and an aperture generally perpendicular to the channel and aligned with the barrel of the pneumatic fastener gun and shaped to permit passage of the fasteners from the pneumatic fastener gun therethrough, a movable stop located adjacent the opening and biased inwardly into the opening, wherein the movable stop is configured to retain the clip belt within the channel so as to position the leading clip with its fastening aperture in vertical alignment with the aperture and the barrel of the pneumatic fastener gun and one side of the top horizontal portion of the leading clip protruding beyond the opening, wherein the movable stop is releasable to permit egress of the leading clip;

a cutting mechanism aligned with the webbing between the leading clip and the adjacent clip selectively actuable to sever the webbing between the leading clip and the adjacent clip in the clip belt;

a spring-loaded follower in the channel biased toward the front end to advance the deck clips towards the opening against the movable stop; and a plunger switch extending forwardly from the housing and operatively engaged with a safety mechanism on the pneumatic fastener gun, wherein the plunger switch is configured to engage a side edge of a previously positioned decking member and move in the forward and rearward direction when the front end of the housing is positioned abutting against the side edge of the decking member, thereby deactivating the safety mechanism on the pneumatic fastener gun.

2. The deck clip magazine of claim 1, wherein the housing has a door to permit loading of the clip belt therethrough.

3. The deck clip magazine of claim 1, wherein the housing has an open bottom and the clip belt is retained within the channel by two rails extending along at least a portion of the open bottom.

4. The deck clip magazine of claim 1, wherein the spring-loaded follower is biased toward the front end by a constant force spring.

5. The deck clip magazine of claim 1, wherein the movable stop comprises a pair of hooks.

6. The deck clip magazine of claim 1, wherein the movable stop comprises a pair of rollers.

7. The deck clip magazine of claim 1, wherein the cutting mechanism is a cutting blade.

8. The deck clip magazine of claim 1, wherein the front end of the housing has a recess formed therein, which is shaped complementary to a decking member to permit the front end to flush fit over the decking member.

9. The deck clip magazine of claim 1, wherein the housing is attached to the handle of the pneumatic fastener gun by way of a support bar.

10. The deck clip magazine of claim 1, wherein the safety mechanism on the pneumatic fastener gun is a pneumatic safety mechanism and the plunger switch is configured to block the flow of air when the plunger switch is not depressed, thereby causing the safety to remain engaged, and to permit the flow of air when the plunger switch is depressed, thereby deactivating the safety mechanism.

11. The deck clip magazine of claim 1, wherein the safety mechanism is a hydraulic safety mechanism and the plunger switch acts as a piston to displace the fluid in the hydraulic safety mechanism and thereby disengage the safety when the plunger switch is depressed.

12. A deck clip magazine, for use with a pneumatic fastener gun for installing decking members using a plurality of generally T-shaped deck clips, the deck clip magazine comprising:

a housing having a channel defining a forward and rearward direction and shaped to receive the deck clips, a front end with an opening to permit egress of the deck clips forwardly from the channel, and an aperture generally perpendicular to the channel, and a plunger switch extending forwardly from the housing and operatively engaged with a safety mechanism on the pneumatic fastener gun, wherein the plunger switch is configured to engage a side edge of a previously positioned decking member and move in the forward and rearward direction when the front end of the housing is positioned abutting against the side edge of the decking member, thereby deactivating the safety mechanism on the pneumatic fastener gun.

* * * * *